US011318697B2

(12) United States Patent
Karlsson et al.

(10) Patent No.: US 11,318,697 B2
(45) Date of Patent: May 3, 2022

(54) SERVO HYDRAULIC PRESS

(71) Applicant: Automation, Press and Tooling, AP & T AB, Tranemo (SE)

(72) Inventors: Mikael Karlsson, Tranemo (SE); Thomas Carlsson, Ljungby (SE)

(73) Assignee: Automation, Press and Tooling, AP & T AB, Tranemo (SE)

( * ) Notice: Subject to any disclaimer, the term of this patent is extended or adjusted under 35 U.S.C. 154(b) by 170 days.

(21) Appl. No.: 16/339,860

(22) PCT Filed: Oct. 18, 2017

(86) PCT No.: PCT/EP2017/076616

§ 371 (c)(1),
(2) Date: Apr. 5, 2019

(87) PCT Pub. No.: WO2018/073308

PCT Pub. Date: Apr. 26, 2018

(65) Prior Publication Data

US 2020/0039166 A1 Feb. 6, 2020

(30) Foreign Application Priority Data

Oct. 18, 2016 (EP) ..... 16194420

(51) Int. Cl.
*B30B 15/16* (2006.01)
*B21D 22/02* (2006.01)
(Continued)

(52) U.S. Cl.
CPC ..... *B30B 15/161* (2013.01); *B21D 22/02* (2013.01); *B30B 15/166* (2013.01); *B30B 15/20* (2013.01); *F15B 7/006* (2013.01); *F15B 13/00* (2013.01)

(58) Field of Classification Search
CPC ..... B30B 15/0052; B30B 15/16; B30B 15/20; B30B 15/24; B30B 15/161; F15B 9/00;
(Continued)

(56) References Cited

U.S. PATENT DOCUMENTS 2,302,922 A 11/1942 Tucker
2,312,213 A * 2/1943 Ferris ..... B30B 15/24 100/46
(Continued)

FOREIGN PATENT DOCUMENTS

EP 0388476 A1 * 9/1990 ..... H02K 19/103
EP 1793127 A1 6/2007
(Continued)

OTHER PUBLICATIONS

International Search Report for International Application No. PCT/EP2017/076616, dated Jan. 5, 2018 (3 pages).

*Primary Examiner* — Adam J Eiseman
*Assistant Examiner* — Fred C Hammers
(74) *Attorney, Agent, or Firm* — Kagan Binder, PLLC

(57) ABSTRACT

The present invention relates to a servo hydraulic press for sheet metal forming. The press comprises a hydraulic cylinder, at least two servo motors and at least two pumps for supplying pressurized fluid to the hydraulic cylinder, where each servo motor drives at least one pump. The servo motors are operable at variable speed, and the first servo motor and first pump are operable in an opposite direction to the second servo motor and the second pump. With this arrangement, the servo hydraulic press may be operated at low speed without causing damage to the pumps or motors.

11 Claims, 2 Drawing Sheets

(51) Int. Cl.
*B30B 15/20* (2006.01)
*F15B 7/00* (2006.01)
*F15B 13/00* (2006.01)

(58) Field of Classification Search
CPC ..... F15B 9/14; F15B 9/16; F15B 1/04; F15B 1/26; F15B 3/00; F15B 7/08; F15B 11/02; F15B 11/10; F15B 21/00; F15B 21/001; F15B 21/08; F15B 2211/20515; F15B 2211/20561; F15B 2211/20569; F15B 2211/20576; F15B 2211/25; F15B 2211/2658; F04B 53/12
USPC ..... 72/453.01, 453.02, 453.03, 453.06, 454
See application file for complete search history.

(56) References Cited

U.S. PATENT DOCUMENTS 3,493,006 A * 2/1970 Hoffman ..... B30B 15/22 137/115.26
3,873,899 A * 3/1975 Seo ..... B21D 43/021 318/271
5,568,766 A * 10/1996 Otremba ..... B30B 15/161 100/258 R
6,874,343 B1 * 4/2005 Ariji ..... B21D 5/02 72/20.1
9,494,169 B2 * 11/2016 Murakami ..... F15B 13/14
2008/0034956 A1 * 2/2008 Ochi ..... F15B 11/048 91/420
2008/0295564 A1 * 12/2008 Kaneko ..... G05B 19/4061 72/405.13
2010/0209275 A1 * 8/2010 Khalil ..... F04B 53/125 417/545
2011/0107756 A1 * 5/2011 Kondo ..... B64C 25/22 60/428
2014/0071547 A1 * 3/2014 O'Neill ..... G02B 7/02 359/827
2014/0283508 A1 * 9/2014 Hiraku ..... E02F 9/2292 60/328
2018/0002000 A1 * 1/2018 Hagihara ..... F15B 11/04
2018/0185900 A1 * 7/2018 Otto ..... B21J 11/00

FOREIGN PATENT DOCUMENTS

WO 2012055579 A1 5/2012
WO WO-2012055579 A1 * 5/2012 ..... B30B 15/16

* cited by examiner

SERVO HYDRAULIC PRESS

CROSS-REFERENCE TO RELATED APPLICATIONS

This application claims priority to International Application No. PCT/EP2017/076616, filed Oct. 18, 2017 and titled "SERVO HYDRAULIC PRESS," which in turn claims priority from a European Application having Ser. No. 16194420.2, filed Oct. 18, 2016, and titled "SERVO HYDRAULIC PRESS," both of which are incorporated herein by reference in their entireties.

TECHNICAL FIELD

The present disclosure relates to a servo hydraulic press, and especially a press for pressing sheet metal.

BACKGROUND

In the field of sheet metal processing, there is sometimes a need for pressing the metal to a desired shape. A common way to achieve this is by use of a servo hydraulic press.

In these types of presses it is sometimes desirable to regulate the pressure inside the hydraulic press. A common way to regulate the pressure is by the use of a servomotor to control the flow of a pressurized fluid inside the press.

A particular problem with these types of presses is the damage to the motor and pump that occurs when operating the motor and pump at a low speed. Therefore, there is a need for a servo hydraulic press which can be operated at low speed without inflicting damage to its components.

SUMMARY

It is an object of the present invention to provide an improved solution that alleviates the mentioned drawbacks with present devices.

The invention is defined by the appended independent claims, with embodiments being set forth in the dependent claims, in the following description and in the attached drawings.

According to a first aspect of the invention, there is provided a servo hydraulic press for sheet metal forming comprising a hydraulic cylinder, at least two servo motors, and at least two pumps for supplying pressurized fluid to the hydraulic cylinder. Each servo motor drives at least one pump. The servo motors are operable at variable speed, and the at least one first servo motor and its associated at least one first pump are operable in an opposite direction to at least one second servo motor and its associated at least one second pump.

With this arrangement, the servo hydraulic press may be operated at low speed without causing damage to the pumps or motors. Operation of a first motor in one direction and at least a second motor in another direction means the total pressure and speed may be reduced as the operation of the first motor in one direction cancels out or reduces the operation of the other motor or motors in the opposite direction, the resultant speed being the difference between the speeds in the two opposite directions. The output pressure of each hydraulic pump may be constant, while the speed of the motor may control the output fluid flow of the hydraulic pump. The resulting fluid flow to the hydraulic cylinder may thereby be controlled.

In an example embodiment, the servo hydraulic press comprises one first servo motor driving a first hydraulic pump and one second servo motor driving a second hydraulic pump. The first servo motor is operable in a first direction and the second servo motor is operable in a second direction opposite said first direction. The first hydraulic pump is thereby operable in said first direction and the second hydraulic pump is operable in said second direction. The aggregated fluid flow provided by the two hydraulic pumps, together providing a fluid flow to the hydraulic cylinder, may thereby be lower than the fluid flow provided by each hydraulic pump. The first hydraulic pump may for instance provide a fluid flow of 300 liter/minute in the first direction to the hydraulic cylinder. The second hydraulic pump may at the same time provide a fluid flow of 200 liter/minute in the second direction. A resulting fluid flow of 100 liter/minute to the hydraulic cylinder may thereby be provided.

The fluid flow and direction of each hydraulic pump may be provided by the direction and speed of the corresponding servo motor.

The direction and speed of each servo motor may be controlled by a control unit. The control unit may be configured to control the direction and speed of the servo motors based on a desired operation of the hydraulic cylinder. The control may be configured to provide a control signal to each servo motor, either directly to each servo motor or via a servo motor drive unit which may be provided to each servo motor to control the operation of the servo motor. The control unit may thereby provide a control signal to a first servo motor to operate in the first direction at a first speed, and a control signal to a second servo motor to operate in the second direction at a second speed. The first speed and the second speed may differ in order to provide a difference in speed between the two servo motors and the resulting hydraulic pressure from the hydraulic pumps driven by the servo motors.

According to one embodiment, each servo motor and/or pump may be operable in two directions. Each servo motor being operable in both directions allows for variation between in which direction the motor is being operated and the operation of the motors may thereby be adjusted such that the life length of all pumps is substantially equal.

When the hydraulic press is operating there may be no need for pressure regulation at low speeds. The servo motors may thereby be operated in the same direction until pressure regulation is needed. Pressure regulation may be required when the cylinder is not at work but required to maintain a certain pressure. At least the first motor, and to this motor corresponding one or more pumps, may then be operated in an opposite direction in relation to the other servo motors and corresponding pumps.

According to another embodiment, the supply of pressurized fluid may be a closed loop supply. The closed loop is configured by an internal valve in the hydraulic cylinder. In the internal valve the pressurized fluid is transported between an upper chamber and a lower chamber depending on the working status of the cylinder. When the cylinder is moved towards a metal sheet to perform the pressing, the internal valve may be closed and pumps transport the pressurized fluid from the lower chamber to the upper chamber such that a force is generated and the cylinder with a working tool is pressed against the sheet metal. After the pressing, the valve may open and the fluid is reversely transported from the upper chamber to the lower, thus maintaining the pressurized fluid in the closed loop.

According to another embodiment, the servo motors may be reluctance motors. The servo motors being reluctance motors allows for a synchronous motor with high efficiency and high torque density. Out of the at least two servo motors, the first servo motor may serve as motor and the second servo motor may serve as generator.

According to another embodiment, the servo hydraulic press may further comprise at least one control valve. Control valves may be used to rinse the system or to increase the level of operational safety.

In another embodiment the at least one control valve may be manually operated. In a further embodiment the at least one control valve may be automatically operated. The control valves may be operated either automatically or manually. The number of control valves may also depend on the manner of operation.

According to a second aspect of the invention, a method for controlling a hydraulic cylinder in a servo hydraulic press for forming sheet metal, comprising the steps of supplying pressurized fluid to the hydraulic cylinder by means of at least two pumps, using at least two servo motors to drive at least one pump each, operating the servo motors at variable speed, and operating at least one first servo motor and at least one first pump in an opposite direction to at least one second servo motor and at least one second pump, is provided.

With this arrangement the servo hydraulic press may be operated at low speed while operating the motors and pumps at sufficient speed as not to provoke damage to the pumps due to too low operation speed.

Each motor shaft may be connected to one or more pumps. Of the at least two motors, the first may serve as motor and the second may serve as generator. The variable speed of the motors may serve to adjust the speed depending on whether the press is in operating mode or in idle mode.

By comprising at least two pumps and motors, at least one first motor and corresponding pump or pumps on the first motor shaft, may be operated in an opposite direction in relation to at least a second motor and its corresponding pump or pumps, which allows for operation of the servo hydraulic press at low speed while the pumps and motors are operated at higher speed. The opposite directions of the motors and corresponding pumps may result in a lower total speed as the resultant speed is the difference between the two opposing speeds.

When the press is in operating mode the motors may be operated in the same direction such as to achieve a sufficiently high speed and pressure for the operation of the press.

In an example embodiment, the servo hydraulic press comprises one first servo motor driving a first hydraulic pump and one second servo motor driving a second hydraulic pump. The first servo motor is operable in a first direction and the second servo motor is operable in a second direction opposite said first direction. The first hydraulic pump is thereby operable in said first direction and the second hydraulic pump is operable in said second direction. The aggregated fluid flow provided by the two hydraulic pumps, together providing a fluid flow to the hydraulic cylinder, may thereby be lower than the fluid flow provided by each hydraulic pump.

The output pressure of each hydraulic pump may be constant, while the speed of the motor may control the output fluid flow of the hydraulic pump. The resulting fluid flow to the hydraulic cylinder may thereby be controlled. The fluid flow and direction of each hydraulic pump may be provided by the direction and speed of the corresponding servo motor.

In another embodiment, the method may further comprise the step of controlling the flow of the fluid by use of at least one control valve. Controlling the flow by use of control valves may be needed to rinse the system or to increase the level of operational safety.

In another embodiment, the method may comprise the step of controlling the at least one control valve by manually operation. The method may further comprise the step of controlling the at least one control valve by automatic operation. Depending on the manner of operation the control valves may be operated either automatically or manually.

BRIEF DESCRIPTION OF THE DRAWINGS

This and other aspects of the present invention now be described more in detail, with reference to the appended drawings showing a currently preferred embodiment of the invention.

DETAILED DESCRIPTION

Figure 1:
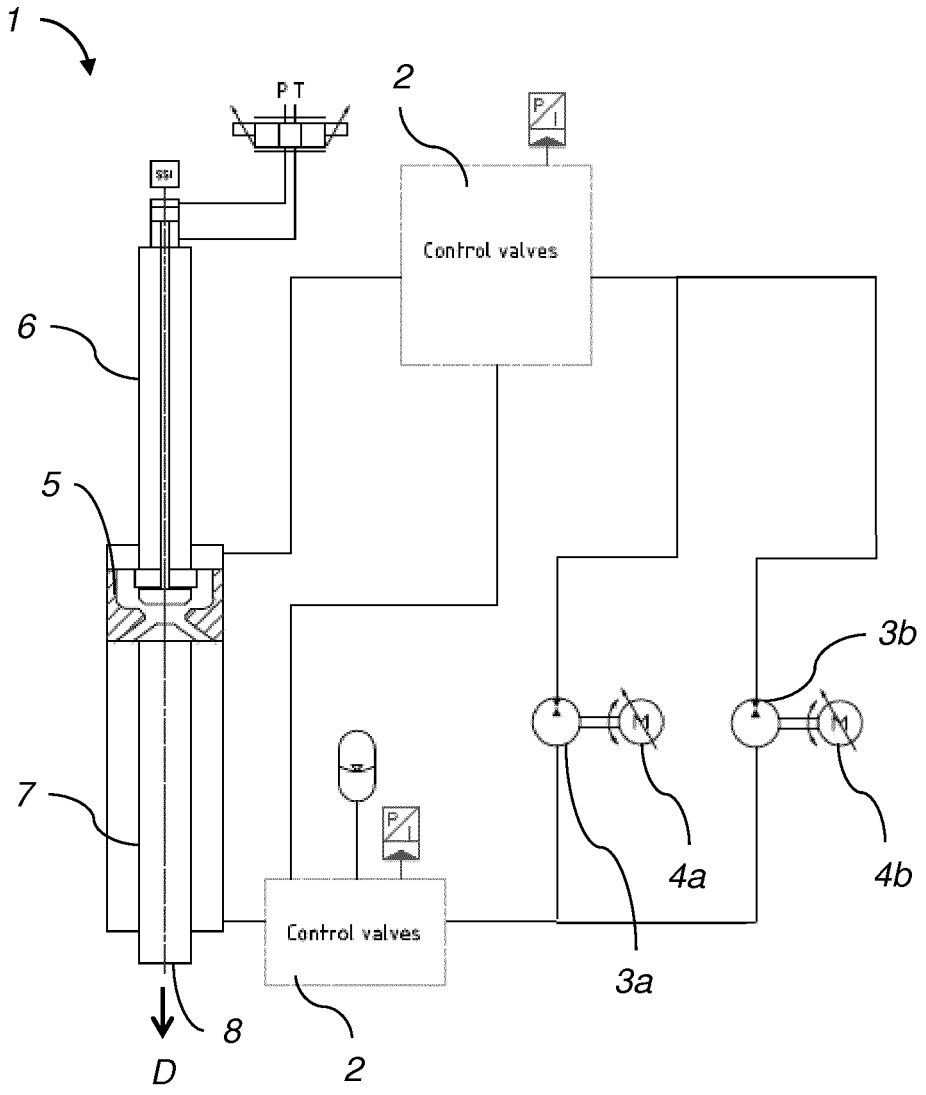
FIG. 1 shows a schematic view of a servo hydraulic press.

The present invention will be described more fully hereinafter with reference to the accompanying drawings. In the drawings, like numbers refer to like elements.

The servo hydraulic press 1 according to the invention is schematically illustrated in FIG. 1. The servo motors 4*a*, 4*b* drive the pumps 3*a*, 3*b*. The motors are reluctance motors. The control valves 2 are used to rinse the system and add security to the system by manual or automatic control. The cylinder comprises an upper cylinder 6 and a lower cylinder 7. One end of the lower cylinder comprises an area 8 where the workpiece for working the sheet metal is fixed. When the press is in working mode, the cylinder is moved in the direction D, lowering the workpiece towards the sheet metal. The cylinder comprises an internal valve 5 which controls the flow of the fluid such that the fluid is in a closed loop system. In FIG. 1 the internal valve 5 is illustrated in an open position.

The servo motors 4*a*, 4*b* drive the pumps 3*a*, 3*b* and can be operated in opposite directions and with variable speed. When the press is in idle mode, the first motor and corresponding pump or pumps on the first motor shaft are operated in an opposite direction in relation to the second motor and its corresponding pump or pumps. When the motors are operating in opposite directions the first motor may serve as a motor and the second motor may serve as generator, driven by the flow and pressure from the first motor. Operation in opposite directions allows the servo hydraulic press to be operated at low speed while the pumps and motors are operated at higher speed as the resultant speed is the difference between the two opposing speeds. I.e. the resulting fluid flow to the hydraulic cylinder may be lower than the fluid flow from each hydraulic cylinder since the resulting fluid flow of the two hydraulic cylinders operating in opposite directions becomes lower. The fluid flow from one of the hydraulic pumps cancel out a part of the fluid flow from the other hydraulic pump operating in an opposite direction.

When the press is in operation, the first and second motors are operated in the same direction such as to achieve sufficient pressure for operation.

Figure 2A:
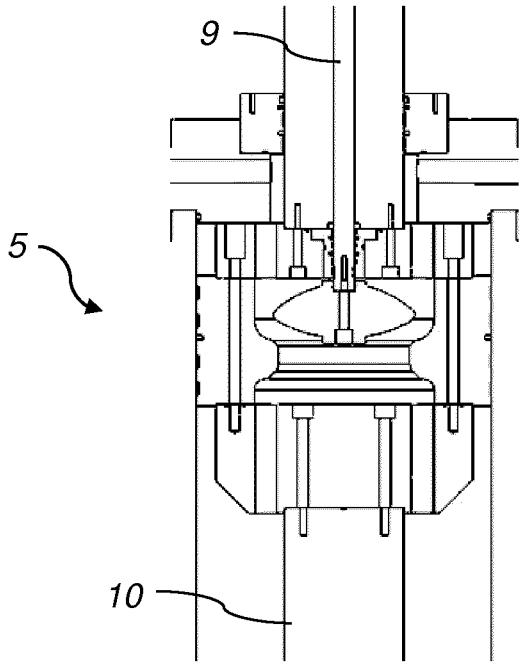
FIG. 2*a* shows a schematic view of an internal valve in an open position.
Figure 2B:
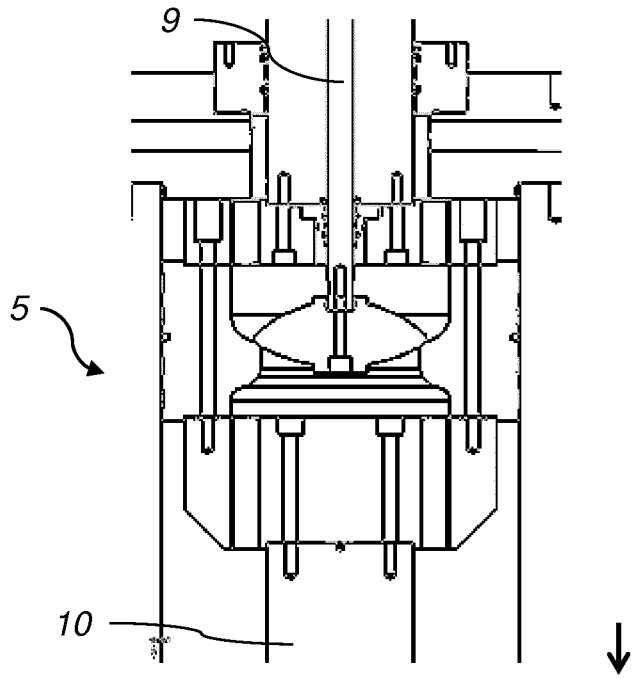
FIG. 2*b* shows a schematic view of an internal valve in a closed position.

The hydraulic system is a closed system comprising an internal valve for regulating the pressing operation. FIGS. 2*a* and 2*b* illustrate the internal valve 5 in the hydraulic press 1 in an open position in FIG. 2*a* and in a closed position in FIG. 2*b*. In the open position, the pressurized fluid flows from the upper chamber 9 to the lower chamber 10. When the cylinder is at work and in a certain position, the valve is moved into a closed position, as illustrated in FIG. 2*b*. In the closed position, the pressurized fluid is transported by use of the pumps 3*a*, 3*b* from the lower chamber 10 to the upper chamber 9, hence generating and exerting a force in the direction D towards which the cylinder is moved such that a sheet metal is formed by pressing. When the work is done, the valve returns to the open position and the pressurized fluid is transported from the upper chamber 9 to the lower chamber 10.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A servo hydraulic press for sheet metal forming comprising:

a hydraulic cylinder;

a first servo motor and a second servo motor;

a first pump and a second pump for supplying pressurized fluid to the hydraulic cylinder, wherein the first servo motor drives the first pump, and the second servo motor drives the second pump, and wherein the servo motors are operable at variable speed, and the first pump and the second pump together provide a total flow of pressurized fluid in a closed loop supply to an upper chamber of the hydraulic cylinder; and a controller configured to operate the first servo motor and the first pump to flow pressurized fluid in an opposite direction to the flow of pressured fluid from the second servo motor and the second pump such that a reduced total flow of pressurized fluid to the upper chamber of the hydraulic cylinder is provided by the first pump and the second pump.

2. The servo hydraulic press according to claim 1, wherein each servo motor and/or pump is operable in two directions.

3. The servo hydraulic press according to claim 1, wherein the servo motors are reluctance motors.

4. The servo hydraulic press according to claim 1, further comprising a control valve.

5. The servo hydraulic press according to claim 4, wherein the control valve is manually operated.

6. The servo hydraulic press according to claim 4, wherein the control valve is automatically operated.

7. A method for controlling a hydraulic cylinder in a servo hydraulic press for forming sheet metal, the method comprising the steps of supplying pressurized fluid in a closed loop supply to an upper chamber of the hydraulic cylinder comprising a first servo motor that drives a first pump and a second servo motor that drives a second pump, operating the servo motors at variable speed, and operating the flow of pressured fluid of the first servo motor and the first pump in an opposite direction to the flow of pressurized fluid from the second servo motor and the second pump such that a reduced total flow of pressurized fluid to the upper chamber of the hydraulic cylinder is provided together by the first pump and the second pump.

8. The method according to claim 7, further comprising the step of controlling a flow of the pressurized fluid by use of a control valve.

9. The method according to claim 8, wherein the step of controlling the control valve is by manual operation.

10. The method according to claim 8, wherein the step of controlling the control valve is by automatic operation.

11. The servo hydraulic press according to claim 1, wherein the closed loop supply is configured by an internal valve in the hydraulic cylinder.

* * * * *